US006689172B1

(12) United States Patent
Feigel et al.

(10) Patent No.: US 6,689,172 B1
(45) Date of Patent: Feb. 10, 2004

(54) AUXILIARY FOR LIMING AND LOOSENING HAIRS OF ANIMAL SKINS

(75) Inventors: Thomas Feigel, Gundersheim (DE); Gertrud Wick, Gundersheim (DE); Peter Wohlmuth, Dieburg (DE); Martin Heise, Einhausen (DE)

(73) Assignee: Trumpler GmbH & Co. Chemische Fabrik, Worms (DE)

( * ) Notice: Subject to any disclaimer, the term of this patent is extended or adjusted under 35 U.S.C. 154(b) by 67 days.

(21) Appl. No.: 09/786,907

(22) PCT Filed: Jun. 30, 2000

(86) PCT No.: PCT/EP00/05076

§ 371 (c)(1),
(2), (4) Date: Mar. 12, 2001

(87) PCT Pub. No.: WO01/06020

PCT Pub. Date: Jan. 25, 2001

(30) Foreign Application Priority Data

Jul. 20, 1999 (DE) ..... 199 33 968

(51) Int. Cl.[7] ..... C14C 1/06
(52) U.S. Cl. ..... 8/94.16; 8/161; 8/94.15
(58) Field of Search ..... 8/94.16, 161, 94.15

(56) References Cited

U.S. PATENT DOCUMENTS

| | | | | |
|---|---|---|---|---|
| 4,175,922 A | | 11/1979 | Eckert et al. | 8/94.16 |
| 4,294,087 A | | 10/1981 | Monsheimer et al. | 69/21 |
| 4,310,328 A | * | 1/1982 | Monsheimer et al. | 8/94.16 |
| 4,631,064 A | | 12/1986 | Juneja | 8/161 |
| 5,710,040 A | | 1/1998 | Christner et al. | 435/265 |

FOREIGN PATENT DOCUMENTS

| | | |
|---|---|---|
| DE | 21 57 034 | 5/1973 |
| DE | 29 11 401 | 10/1980 |
| DE | 29 17 376 | 11/1980 |
| EP | 0 728 844 | 8/1996 |

* cited by examiner

*Primary Examiner*—Yogendra N. Gupta
*Assistant Examiner*—Eisa Elhilo
(74) *Attorney, Agent, or Firm*—Foley & Lardner

(57) ABSTRACT

The invention concerns an auxiliary for liming and loosening hairs of animal skins, containing, in aqueous solution: 10 to 50 wt. % of a polysaccharide solution; 5 to 25 wt. % of a mercapto-carboxylic acid or one of its salts; and 1 to 10 wt. % of a mercapto-alcohol or one of its alkaline salts. Said auxiliary is added during liming of animal skins, to the solution generally containing alkalis, inorganic sulphides or hydrosulphides and anionic or non-ionic surfactants, for standard production of sweatbands.

10 Claims, No Drawings

AUXILIARY FOR LIMING AND LOOSENING HAIRS OF ANIMAL SKINS

Subject of the invention is an adjuvant for opening up and depilation that is used in the manufacturing process known as liming of the untanned corium stripped of the epidermis and subcutaneous connective tissue, the so-called pelt.

As is known the overall leather manufacturing process consists of three main cycles viz. beamhouse, tanning and dressing.

In the beamhouse the salted and dried hides are first restored to the hydrated condition of the green hide by soaking. Then follows a treatment with alkaline baths for opening up and depilating the hides. Depilation and opening up are generally carried out in a single processing step, the liming process. Use is also made of fermentative depilation processes and processes in which the hairs are completely destroyed by the effect of keratolysing agents. Swelling and alkaline reaction are finally eliminated again by neutralisation. In this condition the hide is known as pelt.

The means used for the removal of the hairs, the epidermis and the hair roots generally depend on whether it is intended to chemically destroy the hairs or to save them. If the hairs are of little value, chemical depilatories are applied directly to the hair side of the hides, whereby the hair shafts are destroyed or at least more or less attacked. Normally a calcium suspension containing sulphide is used for this purpose. Industry practice is to carry out this treatment (liming) in large drums with agitation. The calcium suspension affects not only the hairs and the hair roots, but also the leather-building hide substance. This change of the hide substance, liming, is an essential component of the tanning process. To achieve optimal liming effect, little or no consideration is often given to hair saving even in cases where the hairs would be suitable for further use.

During the liming process the hide substance is in the first place opened up by alkaline swelling i.e. its structure is loosened resulting in greater porosity of the leather and special softness or stretch which is for instance desired for gloving leather. Moreover, some accompanying proteins of the fibrillar connective tissue are dissolved out. Duration and intensity of the liming can only be determined empirically in each case, because the various hides react quite differently to the liming process. Too much swelling can cause a "loose" or "running" grain i.e. the top skin layer, containing the hair root pores, empty sweat glands and a ramified system of blood vessels comes loose from the compact fibre layer underneath when the leather flexes and forms creases. Liming is understood to include depilation and opening up of the hide, because they are often combined in one process. However, in most cases the two processes only overlap partly, because usually depilation and/or hair destruction are carried out first followed by the opening up of the hide substance. Just as in the depilation process, many individual factors also work together in the opening process. The liming chemicals must above all attack the keratin of the hairs and the epidermis without destroying the collagen of the hide. The keratin can be removed by reduction and hydrolysis. Hydrolytic bases for this purpose are e.g. calcium hydroxide, hydrated lime [with 80–96% $Ca(OH)_2$] and caustic soda solution. Sodium sulphide, sodium hydrogen sulphide and calcium hydrogen sulphide have a reducing effect. The action of these substances also destroys the epidermis so that this layer together with the hairs can be easily removed with a blunt unhairing knife or by machine. The same as in depilatories the sodium sulphide has a reducing effect on the sulphurous amino acids of the keratin. After that the caustic lime can attack more easily and cause hydrolytic decomposition of the prekeratins in the basal cell layer of the epidermis.

After the hairs and the epidermis have been removed, the flesh and fat remnants adhering to the underside of the subcutaneous connective tissue are taken off with the sharp fleshing knife or the cylinder fleshing machine. The untanned corium without epidermis and subcutaneous connective tissue contains in moist condition 60 to 80% water and fat, the rest is ca. 98% collagen.

From the European patent application EP 0 728 844 we already know a multifunctional leather processing agent for the leather manufacture in the beamhouse. This agent contains a solution of proteolytic and lipolytic enzymes, molasses and hydrotropes and possibly other dispersive, swelling-inhibiting, depilatory or calcium-dissolving additives. This agent serves above all for improving the rehydration and dirt removal in the soak, improving the depilation, inhibiting swelling in the lime pit and improving the surface cleaning of the hide in the bate. Although a combination preparation of this kind already provided advantages over the hitherto practised individual use of the enzymes mentioned, there still remained the problem of finding an improved and surer liming process in order to obtain a better leather quality.

Now it was found that this problem can be solved by an adjuvant for opening up and depilation of animal hides which in aqueous solution contains:

10 to 50 Percentage by weight of a polysaccharide solution 5 to 25 Percentage by weight of a mercaptocarboxylic acid or of one of its salts and 1 to 10 Percentage by weight of a mercaptoalcohol or one of its alkali salts.

In the adjuvant as per invention molasses is used preferably as polysaccharide solution. The use of molasses in leather processing is already known as such. Molasses can be added during all operations in the beamhouse. The addition of molasses during liming is particularly useful, because it clearly improves the solubility of the hydrated lime in the float so that improved opening up of the hide is obtained. Although molasses generally deserves preference as a particularly economical saccharide solution, it is also possible to use other solutions containing water-soluble carbohydrates, e.g. sugar solutions with a sugar content of ca. 10 to 70 percentage by weight.

A further important constituent of the adjuvant as per invention is a mercaptocarboxylic acid or one of its salts, preferably thioglycolic acid. The use of these mercaptocarboxylic acids as keratolysing agents is already known. They are used extensively for hair treatment, but also as a depilatory. Thioglycolates also have been used in tanning for the unhairing of hides, but did not acquire much technical significance for this application.

A further constituent of the adjuvant as per invention is a mercaptoalcohol, in particular mercaptoethanol in the form of its sodium alcoholate. It produces a pronounced depilatory effect.

The adjuvant as per invention delivers a clear quality improvement of the leather so treated. The expert particularly notices that its use results in brighter pelts and that this leads to a greater range of leather qualities. An additional factor is that use of the adjuvant under discussion makes for particularly smooth pelts thus minimising the surface loss normally attending the leather manufacture from a hide. Moreover, the adjuvant as per invention leads to a very high calcium solubility which is a requirement for optimal opening up of the hide.

The adjuvant as per invention provides other advantages with regard to the quite high environmental stress traditionally associated with leather manufacture. Use of the adjuvant makes it possible to considerably reduce the quantity of inorganic sulphides or hydrosulphides in the liming process. The removal of these chemicals from the effluent can pose a significant problem. Furthermore, the swelling of the hide during liming is easier to regulate with the combination preparation as per invention than with the exclusive addition of sulphides or hydrogen sulphides. Finally, it obviates the need for primary aliphatic amines and other organic nitrogen compounds, which have to date often been added for depilation during the liming process. Not only do these amines and nitrogen compounds spread an offensive smell, but they must also be eliminated during the wastewater treatment which requires further technical effort.

A major characteristic of the adjuvant as per invention is that it contains neither proteolytic nor lipolytic enzymes whose use in liming has to date been the prevailing standard. However, enzymes do not only have the disadvantage of being relatively expensive, but also require strictly controlled process conditions to achieve maximum results. If during the treatment of animal hides with enzymes, optimal temperature and pH requirements are not observed, the action of the enzymes used is often inadequate and sometimes too intensive. On the one hand they are supposed to remove albumins and globulins from blood remnants in the animal hides, on the other hand also decompose proteoglycans sheathing the collagen fibres and furthermore make the epidermis more permeable so that the hide is rehydrated faster and is smoother, cleaner and softer after soaking. Enzymic action cleans away the proteins that are not leather-building, removes remnants of hair roots and fat and partly decomposes the elastin in the grain resulting in increased softness of the leather. Complete decomposition of the elastin which can be seen time and again when enzymic action is too strong, is of course undesirable, because then the grain layer partly collapses which has a negative effect on the smoothness and cleanness of the leather. It is essential that the structure of the collagen fibres is not damaged by the liming process. As the action of enzymes is closely governed by the prevailing temperature and pH conditions, the use of enzymes dictates constant, careful control of the processing conditions. These disadvantages are no longer present when the adjuvant as per invention is used, because it does not rely on enzymes.

The adjuvant as per invention can be further improved by the addition of hydrotropic substances. These are substances whose addition improves the water solubility of another difficult to dissolve substance. This includes organic nitrogen compounds like urea, thiourea, formamide, acetamide, N-methyl acetamide and guanidine hydrochloride. However, organic sulphonic acids, carboxylic acids and their salts e.g. cumene sulphonate and even calcium chloride have hydrotropic effects as well. In the presence of proteins, hydrotropes effect a decomposition of the hydrogen bonds between the peptide chains and consequently a swelling which facilitates the access for the active keratolytic ingredients and also for the anionic or non-ionic surfactants used for dissolving the fat.

In the process for opening up and depilation of animal hides the adjuvant as per invention is used in an aqueous solution in addition to the usual alkalis, inorganic sulphides or hydrosulphides and anionic or non-ionic surfactants, whereby it is normally applied in a quantity of 0.1 to 5 percentage by weight. The process is generally carried out at a pH value over 11, preferably at a pH value between 12 and 12.5 and at temperatures between 25 and 35° C. during a period of 15 to 20 hours with intermittent agitation of the animal hides in the tumbling drums used for liming. With the pelt obtained through this process from the raw hide it is possible to manufacture particularly clean and bright leather qualities from which the hair roots have almost completely been removed. The process is easily controllable and yields excellent and constant leather qualities. Furthermore, the environmental stress is clearly reduced, because the wastewater from the process in which the adjuvant as per invention has been used, clearly contains fewer sulphides and no amines or other nitrogenous compounds. It is eminently suitable for processing hides of all kinds, like those of sheep, goats and pigs, but especially cattle hides.

The process as per invention is clarified by the following examples:

Example 1: Depilatory treatment of cattle hides in soak and lime pit

| | | | |
|---|---|---|---|
| Material: | salted cattle hides | | |
| Working vessel: | drum<br>% details relative to salted weight | | |
| Dirt soak: | 200% water<br>0.1% bactericide<br>0.2% anionic surfactant | 30° C. | 90 minutes agitation |
| Drain float | | | |
| Main soak: | 150% water<br>0.3% bacterial protease<br>0.2% anionic surfactant<br>0.1% bactericide<br>0.3% caustic soda solution, 45% 1:3<br>pH 9.2–9.5<br>temp. 27–29° C. | 28° C. | 270 minutes agitation |
| Drain float | | | |
| Lime pit: | 70% water<br>0.8% polysaccharide solution<br>Na salts from thioglycolic acid and mercaptoethanol<br>1.3% sodium sulphide, 60%<br>1.0% hydrated lime<br>0.1% anionic surfactant | 28° C. | 30 minutes agitation, 15 minutes resting |
| | + 2.0% hydrated lime<br>0.3% sodium sulphide, 60% | | 30 minutes agitation<br>30 minutes resting |
| | + 80% water<br>0.4% caustic soda solution, 45% 1:3 | 28° C. | 60 minutes agitation<br>30 minutes resting<br>then alternately:<br>60 minutes resting.<br>5 minutes agitation<br>total duration<br>16–18 hrs |
| | pH 12.2–12.5<br>temp. 26–28° C. | | |
| Drain float | | | |
| Washing | 200% water<br>0.3% polyphosphate | 26° C. | 10 minutes agitation |
| Drain float | | | |

The hide is then fleshed, split and subjected to normal further processing.

Example 2: Hair-saving treatment of cattle hides in soak and lime pit

| | | | |
|---|---|---|---|
| Material: | salted cattle hide | | |
| Working vessel: | drum<br>% details relative to salted weight | | |
| Dirt soak: | 200% water | 30° C. | |

-continued

| | | | |
|---|---|---|---|
| 1. % bactericide 2. % anionic surfactant | | | 90 minutes agitation |
| Drain float | | | |
| | + 80% water<br>2.0% hydrated lime<br>0.1% lubricant<br>0.5% caustic soda solution, 45% 1:3 | 28° C. | 30 minutes agitation<br>30 minutes resting<br>then alternately:<br>60 minutes resting.<br>5 minutes agitation<br>total duration<br>16–18 hrs |
| | pH 12.2–12.5<br>temp. 26–28° C. | | |
| Drain float | | | |
| Washing | 200% water<br>0.3% polyphosphate | 26° C. | 20 minutes agitation |

The hide is then fleshed, split and subjected to normal further processing.

| | | | |
|---|---|---|---|
| Main soak: 3. % bacterial protease | 150% water | 28° C. | |
| | 0.2% anionic surfactant<br>0.1% bactericide<br>0.3% caustic soda solution, 45% 1:3<br>pH 9.2–9.5<br>temp. 27–29° C. | | 270 minutes agitation |
| Drain float | | | |
| Lime pit: | 70% water<br>0.8% polysaccharide solution<br>Na salts from thioglycolic acid and mercaptoethanol | 28° C. | |
| | + 1.0% hydrated lime<br>0.1% anionic surfactant | | 30 minutes agitation,<br>15 minutes resting<br>15 minutes agitation |
| | + 1.1% sodium hydrosulphide, 72% | | 60 minutes agitation<br>separate hairs after 30 minutes (hair filter) |
| | + 80% water<br>2.0% hydrated lime<br>0.1% lubricant<br>0.5% caustic soda solution, 45% 1:3 | | 30 minutes agitation<br>30 minutes resting<br>then alternately:<br>60 minutes resting.<br>5 minutes agitation<br>total duration<br>16–18 hrs |
| | pH 12.2–12.5<br>temp. 26–28° C. | | |
| Drain float | | | |
| Washing | 200% water | 26° C. | 15 minutes agitation |
| Drain float | | | |
| Washing | 200% water<br>0.3% polyphosphate | 26° C. | 20 minutes agitation |

The hide is then fleshed, split and subjected to normal further processing.

What is claimed is:

1. Adjuvant for opening up and depilation of animal hides, wherein said adjuvant comprises an aqueous solution of:

10 to 50 percent by weight of molasses, 5 to 25 percent by weight of a mercaptocarboxylic acid or one of its salts and 1 to 10 percent by weight of a mercaptoalcohol or one of its salts.

2. Adjuvant according to claim 1, wherein said mercaptocarboxylic acid is thioglycolic acid.

3. Adjuvant according to claim 1, wherein said mercaptoalcohol is mercaptoethanol.

4. Adjuvant according to claim 1, wherein said adjuvant further comprises a hydrotropic substance.

5. Adjuvant according to claim 4, wherein said hydrotropic substance is selected from the group consisting of urea, thiourea, formamide, acetamide, N methyl acetamide, guanidine hydrochloride, cumene sulphonate or calcium chloride.

6. Adjuvant according to claim 1, wherein said adjuvant further comprises an anionic or non-ionic surfactant.

7. Process for opening up and depilation of animal hides by liming by means of a solution containing alkalis, sulfides and anionic or non-ionic surfactants, wherein the sulfides are selected from the group consisting of inorganic sulfides and hydrogen sulfides, and further wherein an adjuvant according to claim 1 is added to the solution.

8. Process according to claim 7, wherein the adjuvant is added to the solution used for liming in a quantity of 0.1 to 5.0 percent by weight.

9. Process according to claim 7, wherein said process is carried out in the tumbling drums used for liming at a pH of at least 11 and at temperatures between 25 and 35° C. during a period of 15 to 20 hours with intermittent agitation of the animal hides.

10. The process according to claim 9, wherein the pH is between 12 and 12.5.

* * * * *